United States Patent [19]

Yamada et al.

[11] 4,383,029

[45] May 10, 1983

[54] RECORDING MEDIUM AND RECORDING SYSTEM

[75] Inventors: Noboru Yamada; Mutsuo Takenaga, both of Katano; Kenichi Nishiuchi, Moriguchi, all of Japan

[73] Assignee: Matsushita Electric Industrial Co., Ltd., Kadoma, Japan

[21] Appl. No.: 383,326

[22] Filed: May 27, 1982

Related U.S. Application Data

[63] Continuation of Ser. No. 179,081, Aug. 18, 1980, abandoned.

[30] Foreign Application Priority Data

Aug. 16, 1979 [JP] Japan ..... 54-104574

[51] Int. Cl.[3] ..... G03C 1/00

[52] U.S. Cl. ..... 430/541; 430/540; 430/495; 430/616; 430/542; 430/945

[58] Field of Search ..... 430/495, 616, 540, 541, 430/542, 375, 374, 945

[56] References Cited

U.S. PATENT DOCUMENTS

| | | | |
|---|---|---|---|
| 1,962,307 | 6/1934 | Hickman et al. | 430/495 |
| 2,369,449 | 2/1945 | Fallesen | 430/616 |
| 2,414,839 | 1/1947 | Schoen | 430/495 |
| 2,749,253 | 6/1956 | Shoemaker et al. | 430/616 |
| 3,700,452 | 10/1972 | Brinkman et al. | 430/495 |
| 3,907,566 | 9/1975 | Inoue et al. | 430/495 |
| 4,188,214 | 2/1980 | Kido et al. | 430/495 |
| 4,198,237 | 4/1980 | Nahara et al. | 430/495 |

*Primary Examiner*—Won H. Louie, Jr.
*Attorney, Agent, or Firm*—Amster, Rothstein & Engelberg

[57] ABSTRACT

Disclosed in this invention is a recording medium characterized by forming on the support a recording layer containing a metastable sensitive substance which is an intermediate product of a reaction between a first colorless or light-colored material containing the S atoms released by light irradiation and a second colorless or light-colored material which develops color as it is sulfurized by said S atoms.

12 Claims, 5 Drawing Figures

RECORDING MEDIUM AND RECORDING SYSTEM

This is a continuation of application Ser. No. 179,081, filed Aug. 18, 1980, abandoned.

This invention relates to a recording medium and a recording system capable of forming the color image by using a high-density pulsed light such as laser light of flashed light.

Various proposals have been made on the recording materials sensitive to the high-density energy light such as laser beams, and some of these materials have already been put to practical use, but any of these devices is not fully satisfactory. Among the laser-using recording materials disclosed to date in the fields of facsimile, video disc recorders, etc., are the dry metallized paper for using He-Ne gas laser, metal deposition film for using He-Ne gas laser or Ar gas laser and As-Te type amorphous deposition film. However, the dry metallized paper, although high in sensitivity, requires a heat developing step, while the metal deposition film involves the problems that the recording energy is high and the environment might be contaminated by the evaporated metal. Also, such film is unsuited as a recording medium for obtaining the visible images for hard copies, etc., because of the recording principle. Other methods are also envisaged, such as recording with high-output laser by using a heat-sensitive recording paper, but generally these conventional methods require the high-output laser light such as He-Ne gas laser, He-Cd gas laser and, in some cases, Ar laser, $CO_2$ laser, etc., and this has been an obstacle to the attempts for minuaturization of the device, cost reduction and other improvements.

The present invention has been deviced with the object of solving these problems, and it is intended to provide a recording medium which is suited for picture recording and which is high in light responsiveness and sensitivity and has little risk of environmental contamination, and a recording system using such recording medium.

Figure 1:
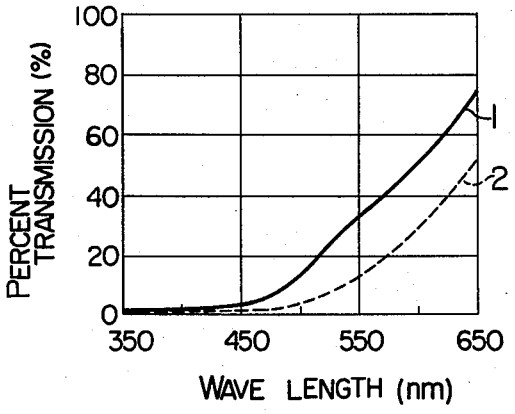
FIGS. 1, 2 and 3 show the spectral transmittances before and after exposure of the recording media according to this invention, said recording media using for its recording layer a $Sb_2Sb_3$-SnO system, a $GeS_2$-SnO system and an $In_2S_3$-$TeO_2$ system, respectively, in the order of the figures.

The invention is now described in detail while having reference to the accompanying drawings.

Described first is the recording system according to this invention. Firstly, a recording layer containing a metastable sensitive substance comprising a reaction intermediate product is formed on a support either by simultaneously depositing a first colorless or light-colored material containing the sulfur (S) atoms released by light irradiation and a second colorless or light-colored material, which develops color upon being sulfurized with the sulfur atoms, on the support from two material sources or by first mixing said both materials by using a binder and then coating the mixture on the support, and then this recording layer is irradiated with light in correspondence to the recording signal to dissociate the sulfur atoms from the first material and react the dissociated sulfur atoms with the second material to produce a colored sulfide to thereby record the recording signal.

The recording medium according to this invention comprises a recording layer provided on a support such as plastic, paper, glass, etc., said recording layer containing a sensitive substance which is in a metastable state and composed of an intermediate product of a reaction between a first material which releases the sulfur atoms upon light irradiation and a second material which develops color upon reaction with the sulfur atoms. As the first material, there may be used the organic sulfur compounds such as thiourea, thiosalicylic acid, thioacetaldehyde, thioformaldehyde, thiourethane, etc., metal sufides such as ZnS, $Al_2S_3$, $Sb_2S_3$, $Sb_2S_5$, $In_2S_3$, CdS, GaS, $Ga_2S_3$, CoS, $Ag_2S$, HgS, SnS, $SnS_2$, SeS, $Tl_2S$, $Tl_2S_3$, FeS, $Cu_2S$, CuS, $Na_2S$, PbS, NiS, $Bi_2S_3$, MoS, $MoS_2$, $TiS_2$, $P_2S_5$, MnS, CrS, etc., or sulfur in its single form. Among them, the metal sulfides are excellent because of relatively easy deposition and high recording sensitivity, and especially $Sb_2S_3$, $In_2S_3$, $Ag_2S$, SnS, $SnS_2$, $Bi_2S_3$, ZnS, GeS and $GeS_2$ can give a light-colored high-sensitivity recording layer. Particularly, $Sb_2S_3$, $InS_3$, $GeS_2$ and $Bi_2S_3$ show the excellent properties.

As the second material, there may be used the metals such as Pb, Bi, Ag, Sn, Sb, Te, Se, Cu, Mg, Sc, Y, Ti, Cd, Zn, In, Si, Ge, As, Al, Ga, Cr, Mn, Fe, etc., metal oxides such as ZnO, $Sb_2O_3$, $In_2O$, InO, $In_2O_3$, $OsO_4$, CdO, $Ga_2O$, $Ga_2O_3$, $Ag_2O$, $Co_2O_3$, $MoO_3$, SnO, $SnO_2$, $Tl_2O$, $WO_3$, $Bi_2O_3$, $TeO_2$, PbO, $Pb_3O_4$, $PbO_2$, $Nb_2O_5$, $V_2O_5$, $Ni_2O_3$, etc., metal halides such as $PbI_2$, $BiI_3$, AgI, $SnI_2$, $SnI_4$, $SbI_3$, CuI, $ZnI_2$, $AlI_3$, InBr, etc., or organic metal salts such as lead acetate, zinc acetate, lead oxalate, zinc oxalate, silver acetate, silver oxalate, lead citrate, silver citrate, zinc citrate, etc. Among them, the metal oxides are excellent in that they can provide a high-sensitivity light-colored recording layer, and especially SnO, $TeO_2$, $Pb_3O_4$, $Bi_2O_3$, $In_2O_3$, $Tl_2O_3$, $Tl_2O$, $Sb_2O_3$, $MoO_3$ and $Ag_2O$ show the excellent properties.

As the binder used in case of forming the recording layer by coating, there may be employed nitrocellulose. PVA (polyvinyl alcohol), polyvinyl acetate, polyacrylic acid ester or the like diluted with a suitable solvent such as acetone, ethanol, etc. In case of forming the recording layer by means of deposition, it is possible to employ the sputtering technique. The degree of vacuum used for the deposition operation including sputtering may be around $10^{-5}$ Torr, and as for the thickness of the recording layer, sufficient contrast can be obtained by providing such thickness of around 1,000–2,000 Å.

The invention is described in further detail hereinbelow by way of the examples thereof.

EXAMPLE 1

Figure 2:
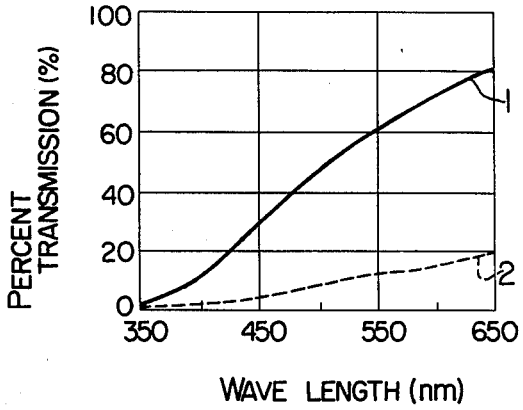
Figure 3:
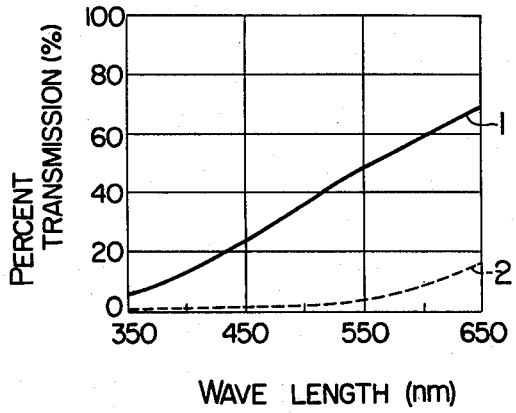
Figure 4:
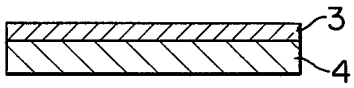
FIG. 4 is a sectional view of a recording medium according to this invention.

Metail sulfides and metal oxides were simultaneously deposited from the separate sources on a polyester support 3 having the thickness of 35μ under the deposition vacuum degree of $5\times10^{-5}$ Torr to form the recording media containing the materials such as shown in the left-side columns in Table 1 and having a recording layer 4 with a thickness of 1,000–2,000 Å as shown in FIG. 4. By exposing the recording layer 4 of each recording medium to Xe flashed light, there were obtained the results such as shown in the right-side columns in Table 1. FIGS. 1–3 show the spectral transmittance curves (before and after exposure) of the recording media obtained in the manner described above. FIG. 1 shows the spectral transmittance curves of the recording medium having its recording layer composed of $Sb_2S_3$-SnO, FIG. 2 shows those of the recording medium having a $GeS_2$-SnO recording layer, and FIG. 3 shows those of the recording medium having an $In_2S_3$-$TeO_2$ recording layer, and in each figure, the solid line 1 shows the spectral transmittance before exposure and the broken line 2 shows the spectral transmittance after exposure.

TABLE 1

| No. | First material | Second material | Color before exposure | Color after exposure | Recording energy (mj/cm$^2$) | Characteristics |
|---|---|---|---|---|---|---|
| 1 | $Sb_2S_3$ | SnO | Light-yellow | Brown | 36 | High sensitivity, high contrast |
| 2 | " | $TeO_2$ | Light-brown | Black | 112 | High sensitivity, high contrast |
| 3 | " | $Bi_2O_3$ | Light-yellow | Light pink | 160 | |
| 4 | " | $Tl_2O_3$ | Light-yellow | Gray | 76 | High sensitivity |
| 5 | " | $Sb_2O_3$ | Light-yellow | Gray | 36 | " |
| 6 | $GeS_2$ | SnO | Light-yellow | Dark brown | 120 | High sensitivity, high contrast |
| 7 | " | $TeO_2$ | Light-brown | Black | 160 | High contrast |
| 8 | " | $MoO_3$ | Light-yellowish green | Brown | 84 | High sensitivity |
| 9 | " | $Tl_2O_3$ | Light-yellow | Yellowish white | 76 | " |
| 10 | " | $Pb_3O_4$ | Light-yellowish brown | Brown | 60 | " |
| 11 | $In_2S_3$ | $TeO_2$ | Light-yellowish brown | Black | 160 | High contrast |
| 12 | " | $Pb_3O_4$ | Light-orange | Black | 280 | " |
| 13 | " | $In_2O_3$ | Light-yellow | Light brown | 160 | " |
| 14 | " | $Tl_2O_3$ | Light-yellowish brown | Brown | 160 | |
| 15 | " | $Ag_2O$ | Light-yellowish brown | Orange | 84 | High sensitivity |

There was also similarly prepared the recording media by using ZnS, $Bi_2S_3$ and $SnS_2$ as the first material and ZnO, PbO, CdO, etc., as the second material, and the similar effects were confirmed.

EXAMPLE 2

The recording media were produced after the manner of Example 1 by using thiourea as the first material and various types of sulfides as the second material, obtaining the results shown in Table 2.

TABLE 2

| No. | First material | Second material | Color before exposure | Color after exposure | Recording energy (mj/cm$^2$) | Characteristics |
|---|---|---|---|---|---|---|
| 1 | Thiourea | Bi | Light-brown | Deep brown | 120 | High sensitivity, high contrast |
| 2 | " | Pb | Brown | Black | 84 | High sensitivity |
| 3 | " | Ag | Yellowish brown | Grayish black | 76 | " |
| 4 | " | Cu | Light-green | Grayish green | 160 | |
| 5 | " | Sb | Grayish brown | Deep brown | 120 | High sensitivity |
| 6 | " | $Bi_2O_3$ | Brown | Dark brown | 152 | High contrast |
| 7 | " | SnO | Yellowish brown | Black | 160 | " |
| 8 | " | $TeO_2$ | Brown | Black | 160 | " |
| 9 | " | $Tl_2O_3$ | Light-brown | Grayish black | 120 | High sensitivity |
| 10 | Thiourea | $MoO_3$ | Light-blue | Dark green | 160 | Specific color tone |
| 11 | " | CuI | Light-brown | Deep brown | 196 | |
| 12 | " | $PbI_2$ | Light-yellow | Yellow | 358 | |
| 13 | " | AgI | Light-yellow | Yellow | 508 | |
| 14 | " | Lead silicate | Brown | Grayish black | 120 | High sensitivity |
| 15 | " | Lead acetate | Brown | Black | 280 | |

There were similarly prepared the recording media by using Se, Te, PbO, $Ag_2O$, $Pb_3O_4$, $PbO_2$, $SnI_2$, $bI_3$, $BiI_3$, $SnI_4$, etc., as the second material, and the similar effect of the products was confirmed.

EXAMPLE 3

Figure 5:
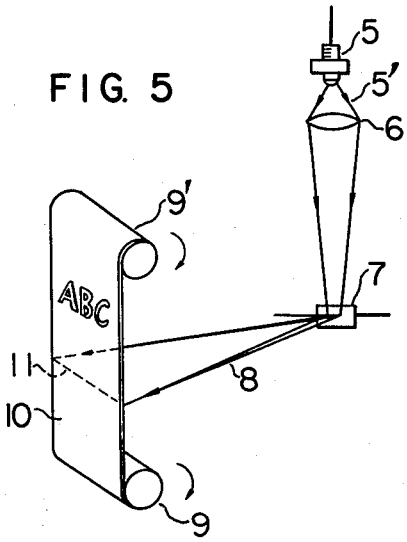
FIG. 5 is a diagrammatic drawing for illustrating the recording system according to this invention.

The semiconductor laser light with an output of 10 W, wavelength of 904 nm, duty factor of 0.1% and pulse duration of 200 n sec., rectified into the beams of $200\mu \times 10\mu$, was applied to the recording media obtained in Examples 1 and 2 as shown in FIG. 5, obtaining the results shown in Table 3.

In FIG. 5, numeral 5 indicates a semiconductor laser diode which emits laser light 5', 6 a condensing lens, 7 a galvano-mirror, 8 the scanning section, 9 and 9' rolls for feeding and taking up the recording medium 10, and 11 the area of the recording medium 10 exposed to the laser light.

TABLE 3

| No. | First material | Second material | Writing by semiconductor laser |
|---|---|---|---|
| 1 | $Sb_2S_3$ | SnO | Δ |
| 2 | " | $TeO_2$ | O |
| 3 | " | $Sb_2O_3$ | O |
| 4 | " | $Pb_3O_4$ | O |
| 5 | $GeS_2$ | SnO | Δ |
| 6 | " | $TeO_2$ | O |
| 7 | " | $MoO_3$ | O |
| 8 | " | $Pb_3O_4$ | O |
| 9 | " | $Tl_2O_3$ | O |
| 10 | $Bi_2S_3$ | $Tl_2O_3$ | O |
| 11 | $In_2S_3$ | SnO | X |
| 12 | " | $TeO_2$ | O |
| 13 | " | $In_2O_3$ | Δ |
| 14 | " | $Ag_2O$ | O |
| 15 | " | $Pb_3O_4$ | X |
| 16 | $SnS_2$ | $MoO_3$ | O |
| 17 | Thiourea | Ag | Δ |
| 18 | " | Pb | Δ |
| 19 | " | $PbI_2$ | X |
| 20 | " | Lead silicate | O |

(Note)
O: Easy to write.
Δ: Slightly difficult to write.
X: Unable to write.

EXAMPLE 4

1 g of nitrocellulose was well dissolved in a mixed solution of acetone and n-butyl alcohol (mixed in the ratio of 2.5 cc of acetone to 1 cc of n-butyl alcohol) to form a binder, and 1 g of $Sb_2S_3$ and 1 g of SnO were added to 100 cc of said binder, and the mixture was crushed and mixed up in a ball mill for about 1 hour to obtain a viscous solution. By using this viscous solution, there was formed a recording layer having the thickness of about 2μ on a paper base having the thickness of about 70μ by a spinner. When this recording layer was irradiated with semiconductor laser light in the same way as in Example 3, the recording layer of gray in color was changed into brown in color.

EXAMPLE 5

A recording layer was formed similar to that prepared in Example 4 by using $In_2S_3$ and $TeO_2$ and irradiated likewise with semiconductor laser light, whereby the recording layer of gray in color was changed into dark brown in color.

As described above, the present invention enables recording by low-output light such as semiconductor laser light or flashed light and can realize minuaturization of the device and cost reduction in adaptation to the various devices such as facsimile, CRT, hard copying machine, etc.

Further, since this invention employs a sulfurization reaction which is generally well-known for its excellent light responsiveness, the device of this invention is suited for picture recording using high-density pulse light, high in recording sensitivity and in recorded picture quality and free of any risk of environmental contamination. Thus, it is expected that this invention will display its splended characteristics in adaptation in the field of optical information recording or visible picture recording.

It is to be particularly noted that when forming the recording layer containing a sensitive composition by simultaneously depositing the basal materials from the multiple deposition sources, the reaction between the two materials is advanced partly to bring the sensitive composition into a metastable state to increase the recording sensitivity. This is considered due to an action of the sulfurization reaction which is completely different from the hitherto conceived one.

Also, in the case of coating, it is possible to obtain a recording medium with excellent stability and color tone in particular by properly selecting the binder as well as the first and second materials.

What is claimed is:

1. A recording medium adapted to be irradiated with high-density pulsed light in response to a recording signal, for recording a visible image, comprising a support, a recording layer formed on said support, said recording layer containing at least a metastable substance composed of an intermediate product of the reaction of a first colorless or light-colored material containing sulfur atoms and a second colorless or light-colored material which develops color upon being sulfurized, the sulfur atoms in said first material being released by high-density pulsed light irradiation and said second material being sulfurized by said released sulfur atoms, said first material being selected from the group consisting of $Sb_2S_3$, $In_2S_3$, ZnS, GeS, $GeS_2$, SnS, $SnS_2$, $Ag_2S$, and $Bi_2S_3$, said second material being selected from the group consisting of SnO, $TeO_2$, $Pb_3O_4$, $Bi_2O_3$, $In_2O_3$, $Tl_2O_3$, $Sb_2O_3$, $MoO_3$ and $Ag_2O$, said first and second materials being reacted such that the reaction advances partly to form said metastable substance, whereby when said metastable substance in said recording layer is irradiated with the high-density pulsed light corresponding to a recording signal, sulfur atoms are dissociated from said first material in the irradiated part of the recording layer, and said dissociated sulfur atoms react with said second material to produce a colored sulfide to record the recording signal as a visible image directly on the recording medium in response to the high-density pulsed light irradiation.

2. A recording medium adapted to be irradiated with high-density pulsed light in response to a recording signal for recording a visible image, comprising a support, a recording layer formed on said support, said recording layer containing at least a metastable substance composed of an intermediate product of the reaction of a first colorless or light-colored material containing sulfur atoms and a second colorless or light-colored material which develops color upon being sulfurized, the sulfur atoms in said first material being released by high-density pulsed light irradiation and said second material being sulfurized by said released sulfur atoms, said first material being selected from the group consisting of $Sb_2S_3$, $In_2S_3$, $GeS_2$ and $Bi_2S_3$, said second material being selected from the group consisting of SnO, $TeO_2$, $Pb_3O_4$, $Bi_2O_3$, $In_2O_3$, $Tl_2O_3$, $Tl_2O$, $Sb_2O_3$, $MoO_3$ and $Ag_2O$, said first and second materials being reacted such that the reaction advances partly to form said metastable substance, whereby when said metastable substance in said recording layer is irradiated with the high-density pulsed light corresponding to a recording signal, sulfur atoms are dissociated from said first material in the irradiated part of the recording layer, and said dissociated sulfur atoms react with said second material to produce a colored sulfide to record the recording signal as a visible image directly on the recording medium in response to the high-density pulsed light irradiation.

3. A recording medium adapted to be irradiated with high-density pulsed light in response to a recording signal for recording a visible image, comprising a support, a recording layer formed on said support, said recording layer containing at least a metastable substance composed of an intermediate product of the reaction of a first colorless or light-colored material containing sulfur atoms and a second colorless or light-colored material which develops color upon being sulfurized, the sulfur atoms in said first material being released by high-density pulsed light irradiation and said second material being sulfurized by said released sulfur atoms, said first material being $Sb_2S_3$, said second material being selected from the group consisting of $TeO_2$, $Sb_2O_3$ and $Pb_3O_4$, said first and second materials being reacted such that the reaction advances partly to form said metastable substance, whereby when said metastable substance in said recording layer is irradiated with the high-density pulsed light corresponding to a recording signal, sulfur atoms are dissociated from said first material in the irradiated part of the recording layer, and said dissociated sulfur atoms react with said second material to produce a colored sulfide to record the recording signal as a visible image directly on the recording medium in response to the high-density pulsed light irradiation.

4. A recording medium adapted to be irradiated with high-density pulsed light in response to a recording signal for recording a visible image, comprising a support, a recording layer formed on said support, said recording layer containing at least a metastable substance composed of an intermediate product of the reaction of a first colorless or light-colored material containing sulfur atoms and a second colorless or light-colored material which develops color upon being sulfurized, the sulfur atoms in said first material being released by high-density pulsed light irradiation and said second material being sulfurized by said released sulfur atoms, said first material being $GeS_2$, said second material being selected from the group consisting of $TeO_2$, $MoO_3$, $Pb_3O_4$ and $Tl_2O_3$, said first and second materials being reacted such that the reaction advances partly to form said metastable substance, whereby when said metastable substance in said recording layer is irradiated with the high-density pulsed light corresponding to a recording signal, sulfur atoms are dissociated from said first material in the irradiated part of the recording layer, and said dissociated sulfur atoms react with said second material to produce a colored sulfide to record the recording signal as a visible image directly on the recording medium in response to the high-density pulsed light irradiation.

5. A recording medium adapted to be irradiated with high-density pulsed light in response to a recording signal for recording a visible image, comprising a support, a recording layer formed on said support, said recording layer containing at least a metastable substance composed of an intermediate product of the reaction of a first colorless or light-colored material containing sulfur atoms and a second colorless or light-colored material which develops color upon being sulfurized, the sulfur atoms in said first material being released by the high-density pulsed light irradiation and said second material being sulfurized by said released sulfur atoms, said first material being $Bi_2S_3$, said second material being $Tl_2O_3$, said first and second materials being reacted such that the reaction advances partly to form said metastable substance, whereby when said metastable substance in said recording layer is irradiated with the high-density pulsed light corresponding to a recording signal, sulfur atoms are dissociated from said first material in the irradiated part of the recording layer, said dissociated sulfur atoms react with said second material to produce a colored sulfide to record the recording signal as a visible image directly on the recording medium in response to the high-density pulsed light irradiation.

6. A recording medium adapted to be irradiated with high-density pulsed light in response to a recording signal for recording a visible image, comprising a support, a recording layer formed on said support, said recording layer containing at least a metastable substance composed of an intermediate product of the reaction of a first colorless or light-colored material containing sulfur atoms and a second colorless or light-colored material which develops color upon being sulfurized, the sulfur atoms in said first material being released by high-density pulsed light irradiation and said second material being sulfurized by said released sulfur atoms, said first material being $In_2S_3$, said second material being selected from the group consisting of $TeO_2$ and $Ag_2O$, said first and second materials being reacted such that the reaction advances partly to form said metastable substance, whereby when said metastable substance in said recording layer is irradiated with the high-density pulsed light corresponding to a recording signal, sulfur atoms are dissociated from said first material in the irradiated part of the recording layer, and said dissociated sulfur atoms react with said second material to roduce a colored sulfide to record the recording signal as a visible image directly on the recording medium in response to the high-density pulsed light irradiation.

7. A recording medium adapted to be irradiated with high-density pulsed light in response to a recording signal for recording a visible image, comprising a support, a recording layer formed on said support, said recording layer containing at least a metastable substance composed of an intermediate product of the reaction of a first colorless or light-colored material containing sulfur atoms and a second colorless or light-colored material which develops color upon being sulfurized, the sulfur atoms in said first material being released by high-density pulsed light irradiation and said second material being sulfurized by said released sulfur atoms, said first material being $SnS_2$, said second material being $MoO_3$, said first and second materials being reacted such that the reaction advances partly to form said metastable substance, whereby when said metastable substance in said recording layer is irradiated with the high-density pulsed light corresponding to a recording signal, sulfur atoms are dissociated from said first material in the irradiated part of the recording layer, said dissociated sulfur atoms react with said second material to produce a colored sulfide to record the recording signal as a visible image directly on the recording medium in response to the high-density pulsed light irradiation.

8. The recording medium according to claim 1, 2, 3, 4, 5, 6 or 7, wherein said metastable substance is produced by substantially simultaneous deposition of the first material and the second material.

9. The recording medium according to claim 8, wherein said deposition is carried out by sputtering.

10. The recording medium according to claim 8, wherein said deposition is carried out under a vacuum of substantially $10^{-5}$ Torr and said recording layer is substantially 1000–2000 A thick.

11. The recording medium according to claim 1, 2, 3, 4, 5, 6 or 7, wherein said recording layer includes a binding material, the recording layer being formed by mixing said first and second materials by using said binding material and then coating the mixed materials on said support.

12. The recording medium according to claim 11, wherein said binding material includes at least one material selected from the group consisting of nitrocellulose, polyvinyl alcohol, polyvinyl acetate and polyacrylic acid ester.

* * * * *